United States Patent [19]

Pfotenhauer

[11] 3,949,729

[45] Apr. 13, 1976

[54] ELASTIC BAND GUIDED ARTICLE PROJECTING DEVICE

[76] Inventor: James M. Pfotenhauer, 1302 N. 19th St., Escanaba, Mich. 49829

[22] Filed: Jan. 6, 1975

[21] Appl. No.: 538,802

[52] U.S. Cl. ..... 124/20 B; 124/20 R; 273/106.5 R; 124/22; 124/30 R

[51] Int. Cl.[2] ..... F41B 7/00

[58] Field of Search ..... 124/22, 25, 26, 27, 21, 124/35 A, 35 R, 41 R, 41 A, 20 R, 20 B; 273/106 R, 106.5 R, 106.5 C, 106.5 B

[56] References Cited

UNITED STATES PATENTS

| | | | |
|---|---|---|---|
| 3,126,880 | 3/1964 | Loe | 273/106.5 R X |
| 3,496,671 | 2/1970 | Korona | 124/26 UX |
| 3,515,113 | 6/1970 | Lawrence | 124/25 X |
| 3,572,311 | 3/1971 | Baer | 124/41 A X |

*Primary Examiner*—Richard C. Pinkham
*Assistant Examiner*—William R. Browne
*Attorney, Agent, or Firm*—Burns, Doane, Swecker & Mathis

[57] ABSTRACT

A slingshot includes a housing formed of releasably separable longitudinal sections. The sections define an upwardly open slot extending fore-to-aft along the housing. A pair of arms project laterally outwardly from a front part of the housing to define anchor points located laterally outwardly and above the slot. An elastic spring has forward ends thereof coupled to the anchor points and converging rearwardly therefrom and above the slot. An plunger is slidably disposed within the slot. A cord is connected between the elastic spring and the plunger so that release of the elastic spring from a tensioned condition causes the plunger to be propelled forwardly within the slot and eject a projectile located thereahead. An underarm butt may be provided at the rear of the housing to provide stabilization for the slingshot during actuation.

8 Claims, 7 Drawing Figures

ELASTIC BAND GUIDED ARTICLE PROJECTING DEVICE

BACKGROUND AND OBJECTS OF THE INVENTION

The present invention relates to a slingshot and more particularly, to a hand-held, spring-powered gun that can be tensioned and fired by the fingers of a user to launch a projectile.

Slingshots have long been known as being a simple, compact means of launching projectiles, as may be appreciated from a review of U.S. Pat. Nos. 844,665; 1,606,609; 2,625,926; 2,715,895; 2,853,992; and 3,415,239. A slingshot can be easily held in one hand of a user, while the user's other hand tensions and releases an elastic band. Normally, a projectile is held within a bight or pouch portion of the band and is launched by stored spring energy when the tensioned band is released.

While being easily handled and rapidly fired, slingshots lack substantial accuracy. Moreover, the manner of supporting a projectile within the elastic band for launching is somewhat awkward and may result in the projectile being inadvertently dropped.

It is an object of the present invention to provide a novel slingshot which essentially preserves classical simplicity and rapid fire characteristics of a slingshot, while maximizing the accuracy and handling thereof.

It is another object of the invention to provide such a slingshot which effectively supports a projectile during launching, absent the need for holding the projectile within an elastic band.

It is an additional object of the present invention to provide such a slingshot which effects an efficient plunger-to-projectile transfer of spring energy.

It is another object of the invention to provide such a slingshot which effectively guides and directs a projectile along a prescribed route during launching.

It is a further object of the invention to provide such a slingshot having improved firepower, accuracy, and stability.

It is a further object of the invention to provide a slingshot which can fire numerous forms of ammunition with high accuracy. The firing can be done with retrievable and reusable ammunition so as to be practicable and economical.

It is another object of the invention to provide such a slingshot which can fire relatively short darts or be adapted to fire steel balls without the danger of a spring or pouch slamming into and endangering the adapter mechanism as in the case of known devices of this sort.

BRIEF SUMMARY OF A PREFERRED EMBODIMENT OF THE INVENTION

These objects are achieved by the present invention wherein a slingshot is provided having a housing with a handgrip. The housing includes an upwardly open projectile discharge slot which extends fore-to-aft along the housing. The slot has a forward discharge opening and is arranged to slidably receive and discharge a projectile. An elastic spring includes portions converging rearwardly from points located laterally outwardly and vertically above the slot. The elastic spring is manually grippable adjacent a convergent end thereof by the fingers of an operator so as to be rearwardly expandible to a tensioned condition above the slot. An impact plunger is slidably disposable in the slot. A coupling member is provided which is operably connected between the elastic spring and the plunger so that release of the elastic spring from a tensioned condition causes the plunger to be propelled forwardly in the slot to advance and launch a projectile located thereahead.

THE DRAWING

Other objects and advantages of the present invention will become apparent from the subsequent detailed description thereof in connection with the accompanying drawings in which like numerals designate like elements and in which.

DETAILED DESCRIPTION OF THE PREFERRED EMBODIMENT

Figure 1:
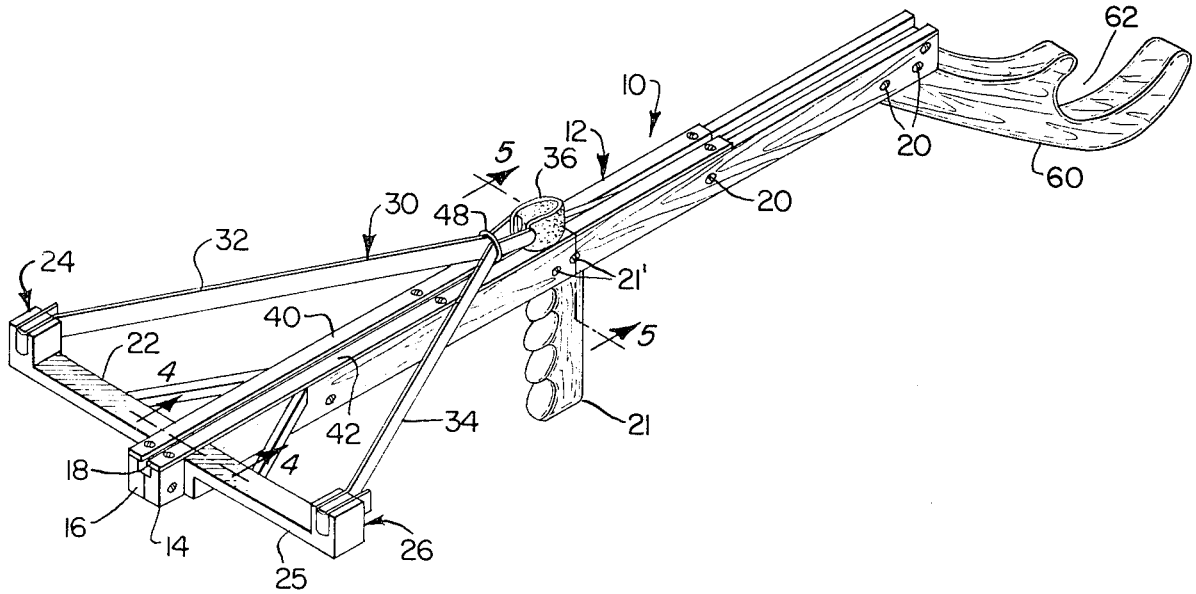
FIG. 1 is a perspective view of a slingshot embodying the principles of the present invention.

A slingshot 10 illustrated in FIGS. 1 through 7 embodies the principles of the present invention. The slingshot includes a housing 12 comprising a pair of longitudinal sections 14, 16. Each of these sections 14, 16 includes a recessed portion which, when the sections are secured together, mates with a recessed portion of the other section to define an upwardly open slot 18 or a partially closed slot ready for use which runs fore-to-aft along the housing. The housing sections 16, 18 are releasably secured by means of suitable releasable fasteners, such as screws 20.

A handgrip 21 may be inserted and clamped between the housing sections 14, 16 by screws 21' to provide a means for holding the slingshot. Screws 21' are provided for securing the handgrip to the housing sections.

At the forward end of the housing 12, a pair of arms 22, 25 are provided. These arms are fastened respectively to housing sections 14, 16 and project laterally outwardly therefrom. The distal ends of the arms define anchor points 26, 28 which are arranged to support an elastic spring member 30 at points disposed outwardly and above the slot 18.

The elastic spring member 30 comprises a pair of elastic sections 32, 34 that are anchored to the anchor points 24, 26 of the arms 22, 25 and are connected to a pouch member 36. The anchored ends of the elastic sections may be secured to the arms 22, 25 in any suitable manner, preferably by tightly wedging the elastic sections within a pair of slots formed in the arms. The elastic sections 32, 24 converge rearwardly from the anchor points toward the pouch 36.

The spring member 30 can be formed of any suitably elastic material, preferably rubber.

Figure 2:
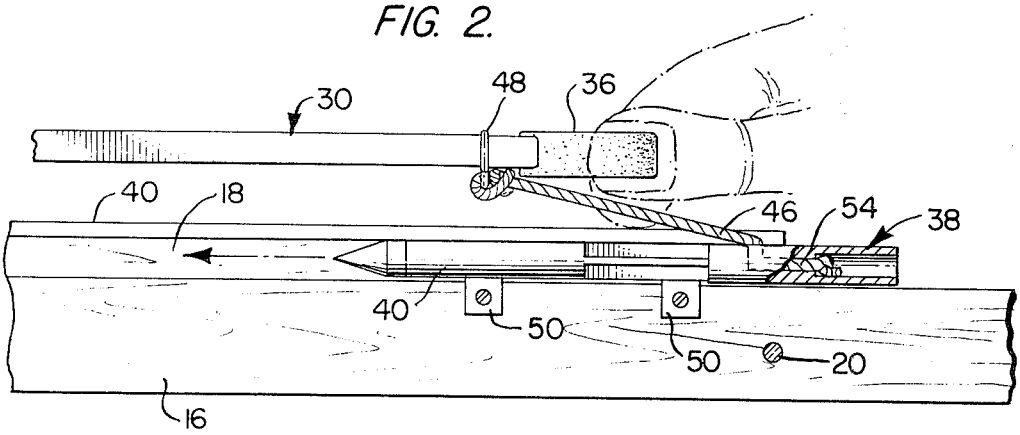
FIG. 2 is a side elevational view of a rear portion of the slingshot with one housing section removed, depicting the firing mechanism in a tensioned condition.

The rear ends of the elastic sections may be attached to respective ends of the pouch 36 in any suitable manner, such as by being sewn or pinned thereto, for example. It will be appreciated that the pouch may be gripped by the fingers of an operator (as shown in FIG. 2) so as to be capable of manual retraction in a spring-stretching, energy-storing manner.

The slot 18 is arranged to slidably receive and discharge a projectile. The projectile can assume numerous shapes and sizes. Darts, steel balls, and the like are among the types of projectiles that can be fired by the slingshot. The slot is preferably of round or square cross-section to maximize accuracy.

An impact plunger 38 is provided to accelerate and launch the projectile, such as a dart 40. The impact plunger 38 is preferably in the form of a hollow tube formed of a lightweight material, such as magnesium, although wood, plastic, and other materials may be employed.

A pair of retainer plates 40, 42 are secured to the tops of the respective housing sections 14, 16 so as to form a restricted opening 44 in the upwardly opened slot 18 that confines the plunger 38 to fore-and-aft longitudinal movement within the slot.

The impact plunger 38 is secured to the elastic spring member 30 such that release of the spring from a tensioned condition causes the plunger 38 to be pulled and advanced forwardly through the slot 18.

The connection between the elastic spring 32 and the plunger 38 is preferably in the form of a flexible cord 46. The cord 46 is preferably secured to a jewelers ring 48 (FIG. 6) through which are disposed the convergent ends of the elastic sections 32, 34. The jewelers ring 48 includes a slidable latch portion 50 and an eyelet 52 through which one end of the cord 46 may be passed and then knotted. The other end of the cord extends through a bore 54 of the plunger and is knotted on the other side thereof so as to be entrained against removal from the forward end of the plunger.

The arrangement is such that with a dart disposed ahead of the plunger 38, and with the elastic spring member 30 held in a tensioned condition (FIG. 2), release of the spring will cause energy stored therewithin to be transmitted to the plunger 38 by means of the cord 46. In this fashion, the plunger 38 will be accelerated forwardly to advance and launch the dart 40 from the slot 18.

If desired, a bridging element (not shown) can be provided at the forward end of the housing so as to extend across the retainer plates 40, 42. Ejection of the plunger 38 from the slot will be prevented through engagement of the cord with the bridging element.

Also, if desired, the ring 48 can be eliminated and the cord can be tied directly to the power bands ahead of the pouch.

The present invention is also suitable for firing steel balls and the like from the slot 18. This use is facilitated by the provision of flexible stop elements 50, 52 which are mounted in the housing and which project slightly into the bottom of the slot 18. These elements may be made of rubber, plastic, or any other suitably resilient material. A steel ball (or balls) to be fired is inserted at the front or rear of the slot 18 and is urged past one of the stop elements so as to be confined between the stop elements 50, 52. In this fashion, the ball will not slide from the slot during carrying or aiming of the slingshot.

Figure 7:
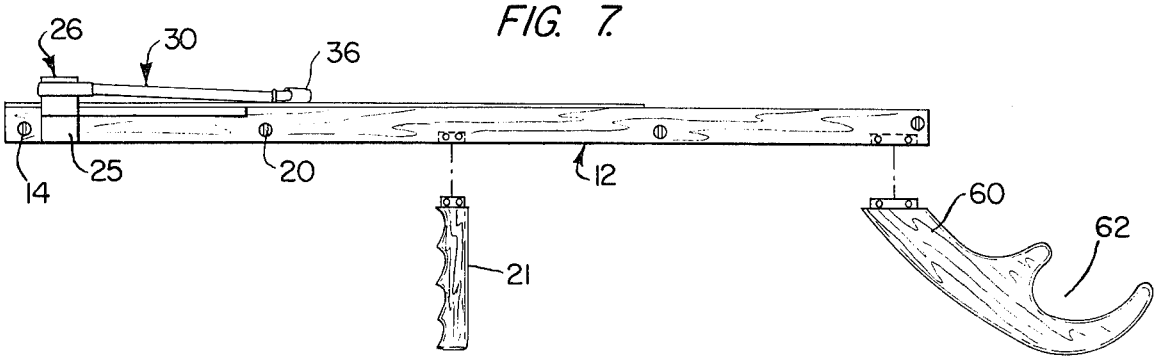
FIG. 7 is a side elevational view of the slingshot with gripping portions thereof shown in a detached posture.

It may be desirable to provide a butt 60 at the rearward end of the housing. One suitable form of butt is illustrated in FIGS. 1 and 7. This butt 60 includes an upwardly open cavity 62 for receiving the underarm of an operator. Thus, with one arm an operator grips the handgrip 21, so that his underarm is cradled within the cavity 62. With the other arm, the operator is able to tension and release the spring 30.

OPERATION

Figure 3:
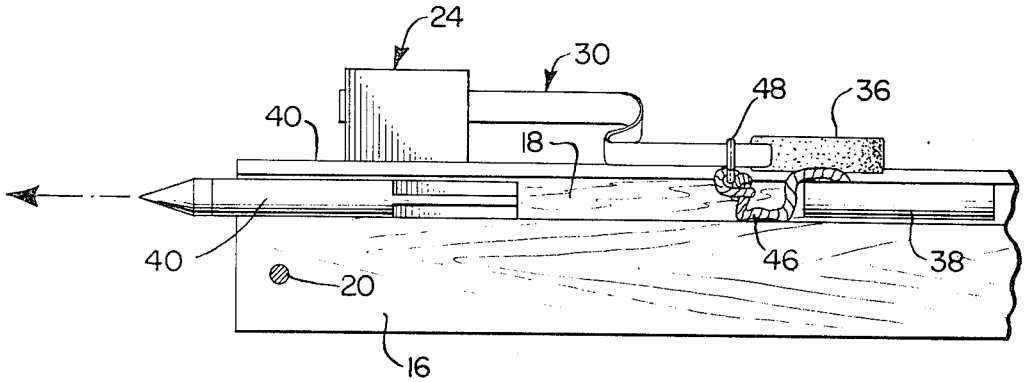
FIG. 3 is a side elevational view of a front portion of the slingshot with one housing section removed, and as a projectile is being inserted therein.
Figure 4:
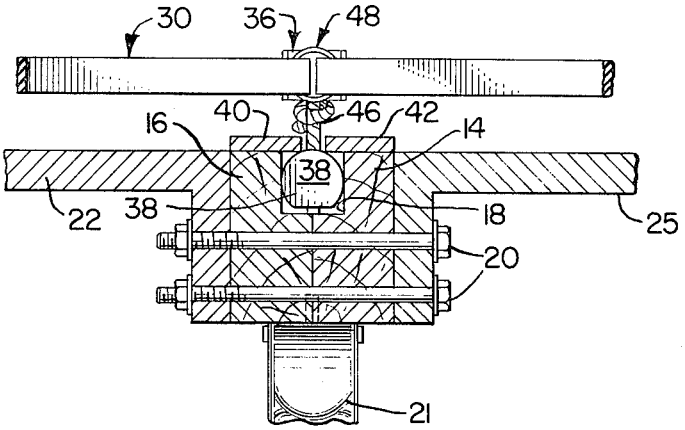
FIG. 4 is a transverse sectional view taken along line 4—4 of FIG. 1.
Figure 5:
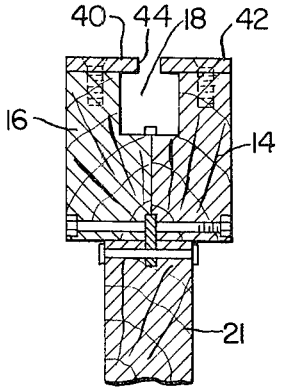
FIG. 5 is a transverse sectional view taken along line 5—5 of FIG. 1.
Figure 6:
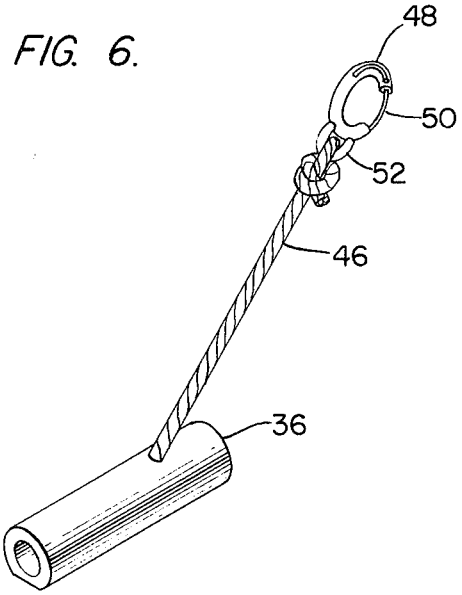
FIG. 6 is a view of an impact plunger component of the slingshot.

In its preferred mode of handling, the slingshot is grasped at the gripping handle 21 by one hand of an operator. A projectile, such as a dart 40, is inserted within the outer end of the slot ahead of the plunger 38 (FIG. 3). When it is desired to discharge the dart 40, the operator, with his other hand, grasps the pouch and retracts the elastic spring. At the same time, the forward end of the housing 12 is slanted upwardly so that the projectile and the plunger slide to their rearwardmost positions. The arms 22, 25 are of relatively solid and heavy-duty construction to enable the slingshot to withstand the high retraction pressures. Also, this makes the front of the slingshot relatively heavy and stable to maximize control during cocking and firing the powerful tension bands. The slingshot is then lowered to a desired firing inclination (FIG. 2). By releasing the pouch, the tensioned elastic band sections contract and thereby propel the plunger 38 forwardly via the cord 46. The plunger 38 thus advances and discharges the dart 40 at high speed from the discharge end of the slot 18.

In the event that a steel ball or the like is to be discharged by the slingshot, the ball can be inserted into the slot 18 and pushed between the stop elements 50, 52 to confine the steel ball within the slot. When the plunger is inserted behind the stop elements and the tensioned elastic band released, the plunger will eject the steel ball, or balls, from the slot 18. The stop elements 50, 52 are sufficiently flexible so as to be easily depressed by the plunger 38 and offer minimal resistance to plunger travel.

If desired, the jewelers ring 48 can be opened to allow the plunger to be disconnected from the elastic spring 30. In this fashion, the pouch 36 will be operable to function in the manner of a conventional slingshot. That is to say, projectiles could be fired directly from the pouch 36.

MAJOR ADVANTAGES AND SCOPE OF THE INVENTION

It will be appreciated that the slingshot of the present invention is easily and rapidly actuable. Since the projectiles are supported and guided within a slot during firing, accuracy of the slingshot is enhanced. Tremendous firepower over conventional slingshots is achieved, as well as wider versatility without obstructions. In addition, the slingshot is reduced so as to facilitate handling thereof.

The use of a plunger slidably disposed within the projectile discharge slot assures a uniform and efficient transfer of spring energy to the projectile.

The use of an underarm butt protects against undue tilting movement of the slingshot, thereby stabilizing the housing during tensioning and firing of the elastic spring.

Although the invention has been described in connection with a preferred embodiment thereof, it will be appreciated by those skilled in the art that additions, modifications, substitutions and deletions not specifically described may be made without departing from the spirit and scope of the invention as defined in the appended claims.

What is claimed is:

1. A slingshot comprising:

a housing having a handgrip;

said housing including an upwardly open and rearwardly open projectile discharge slot extending fore-to-aft along said housing for slidably receiving a projectile, said slot being upwardly open throughout its rearward extent and having a forward discharge opening to discharge a projectile;

an elastic band having portions converging rearwardly from points located laterally outwardly and vertically above said slot;

said elastic band including a convergent end which forms a pouch for being gripped by fingers of an operator so as to be rearwardly expandible to a tensioned condition above said slot;

an plunger slidably disposable in said slot;

a flexible line having a first end disposed out of said slot and connected to said convergent end of said elastic band, and a second end disposed in said slot in connection with said plunger, release of said elastic band from a tensioned condition caused said plunger to be propelled forwardly in said slot to advance and launch a projectile located thereahead.

2. A slingshot according to claim 1 wherein said flexible line comprises a cord connected to said elastic band and to said plunger.

3. A slingshot according to claim 2 wherein said upwardly open slot includes a restricted portion at its top of less width than said plunger; said cord passing through said restricted portion.

4. A slingshot according to claim 1 further including a pair of arms extending generally laterally from said housing; terminal ends of said arms defining said points located laterally outwardly and above said slot; said elastic band being connected at its free ends to said terminal ends of said arms.

5. A slingshot according to claim 1 wherein said plunger includes a bore, said flexible line comprising a cord passing through said bore and being knotted at its free end so that said plunger is constrained to follow said elastic band during firing.

6. A slingshot according to claim 1 including a butt attached to the rear of said housing; said butt including an upwardly open cradle cavity for engagement with the underarm of an operator.

7. A slingshot according to claim 1 wherein said flexible line comprises a cord releasably connected to said convergent end of said band to enable a projectile to be fired directly from said pouch upon disconnection of said cord; said housing including a rearwardly extending butt having an upwardly open cavity for receiving the underarm of an operator.

8. A slingshot comprising:

a housing comprising a pair of releasable fastened longitudinal sections;

each of said housing sections included a recessed portion operable to define a slot when said sections are in mating relationship;

said slot being open at its top and extending fore-to-aft along said housing to receive a projectile;

said slot being rearwardly open, and open at its top throughout its entire rearward extent;

said housing including a downwardly projecting gripping handle;

a pair of arms projecting outwardly from opposite sides of the housing;

said arms defining, at their terminal ends, anchor points located laterally outwardly and above said slot;

an elastic band having forward ends thereof secured to said anchor points;

said elastic band extending in convergent relation from said anchor points, with the convergent end of said elastic band including an enlarged pouch for being gripped by fingers of an operator;

an plunger slidably disposable in said slot;

a flexible cord attached at one end to the convergent end of said elastic band and secured at its other end to said plunger;

the upper end of said slot being restricted to admit passage of said cord while confining said plunger to fore-and-aft movement in said slot;

said plunger being operable, in response to said elastic band being tensioned and released by the fingers of an operator, to engage a projectile located thereahead in said slot and propel a projectile from said slot;

said cord being releasably connected to said convergent end of said elastic band to enable a projectile to be fired directly from said pouch upon disconnection of said cord; and said housing including a rearwardly extending butt having an upwardly open cavity for receiving the underarm of an operator.

* * * * *